US010221489B2

(12) United States Patent
Kalakodimi et al.

(10) Patent No.: US 10,221,489 B2
(45) **Date of Patent: *Mar. 5, 2019**

(54) COMPOSITIONS AND METHODS FOR INHIBITING CORROSION IN HYDROSTATIC SYSTEMS

(71) Applicant: CHEMTREAT, INC., Glen Allen, VA (US)

(72) Inventors: Rajendra Prasad Kalakodimi, Richmond, VA (US); John Richardson, Hanover, VA (US); Curt Turner, Richmond, VA (US)

(73) Assignee: CHEMTREAT, INC, Glen Allen, VA (US)

( * ) Notice: Subject to any disclaimer, the term of this patent is extended or adjusted under 35 U.S.C. 154(b) by 158 days.

This patent is subject to a terminal disclaimer.

(21) Appl. No.: 15/007,771

(22) Filed: Jan. 27, 2016

(65) Prior Publication Data

US 2016/0215400 A1 Jul. 28, 2016

Related U.S. Application Data

(60) Provisional application No. 62/106,785, filed on Jan. 23, 2015.

(51) Int. Cl.

| | |
|---|---|
| ***C23F 11/18*** | (2006.01) |
| ***C23F 11/02*** | (2006.01) |
| ***C23C 22/62*** | (2006.01) |
| ***C23F 11/08*** | (2006.01) |

(52) U.S. Cl.

CPC ..... *C23F 11/02* (2013.01); *C23C 22/62* (2013.01); *C23F 11/08* (2013.01)

(58) Field of Classification Search

CPC ..... C23F 11/02; C23F 11/08; C23C 22/62

See application file for complete search history.

(56) References Cited

U.S. PATENT DOCUMENTS

| | | | | |
|---|---|---|---|---|
| 2,643,177 A | | 6/1953 | Wachter et al. | |
| 3,897,209 A | * | 7/1975 | Harris | C02F 5/105 210/698 |
| 3,907,578 A | * | 9/1975 | Scherrer | C23F 11/02 106/14.18 |
| 4,239,648 A | * | 12/1980 | Marshall | C02F 5/145 106/14.12 |
| 4,501,667 A | * | 2/1985 | Cook | C02F 5/14 106/14.12 |

(Continued)

OTHER PUBLICATIONS

Apr. 8, 2016 International Search Report and Written Opinion issued in International Application No. PCT/US2016/015137.

(Continued)

*Primary Examiner* — Regina M Yoo
(74) *Attorney, Agent, or Firm* — Oliff PLC

(57) ABSTRACT

Compositions and methods for preventing corrosion of equipment having a corrodible metal surface that contacts water in a hydrostatic system are provided. Compositions may include a liquid-phase corrosion inhibitor and vapor-phase corrosion inhibitor. Methods may include introducing into the hydrostatic system a liquid-phase corrosion inhibitor, vapor-phase corrosion inhibitor and/or a scaling inhibitor. A protective film can be formed on the corrodible metal surface.

26 Claims, 8 Drawing Sheets

(56) References Cited

U.S. PATENT DOCUMENTS

| | | | | |
|---|---|---|---|---|
| 4,512,552 | A * | 4/1985 | Katayama | C23F 11/08 252/181 |
| 4,606,890 | A * | 8/1986 | Fisk | C02F 5/145 205/724 |
| 4,681,686 | A | 7/1987 | Richardson et al. | |
| 5,202,058 | A * | 4/1993 | Riggs, Jr. | C23F 11/08 252/387 |
| 5,294,371 | A * | 3/1994 | Clubley | C02F 5/14 210/699 |
| 5,348,731 | A * | 9/1994 | Patti | A61K 8/368 424/45 |
| 6,514,350 | B1 * | 2/2003 | Libutti | C23G 1/24 134/2 |
| 9,290,849 | B2 * | 3/2016 | Richardson | C02F 1/68 |
| 2012/0282136 | A1 | 11/2012 | Richardson et al. | |
| 2014/0138105 | A1 * | 5/2014 | Kuwatch | A62D 1/0035 169/46 |
| 2015/0004054 | A1 | 1/2015 | Richardson et al. | |

OTHER PUBLICATIONS

Aug. 3, 2017 Preliminary Report on Patentability issued in International Patent Application No. PCT/US2016/015137.

* cited by examiner

COMPOSITIONS AND METHODS FOR INHIBITING CORROSION IN HYDROSTATIC SYSTEMS

This application claims the benefit of priority to U.S. Provisional Patent Application No. 62/106,785, filed Jan. 23, 2015. The disclosure of the prior application is hereby incorporated by reference herein in its entirety.

TECHNICAL FIELD

This application is directed to methods for treating equipment and workpieces used in hydrostatic water systems, such as hydrostatic cookers and containers that are sterilized therein, e.g., as used in the food and beverage industry.

BACKGROUND

Corrosion of metallic surfaces used in equipment and workpieces in water systems in the food and beverage industry is a significant problem. Industrial processes exist for the purpose of sterilizing equipment and reducing corrosion in a hydrostatic environment. For purposes of this disclosure, a hydrostatic environment is a state at which there is equilibrium between a liquid and the pressure of steam exerted by liquid at rest. In a hydrostatic cooker, this principle is applied in the context of a system where pressure of saturated steam in a sterilizing zone balances the weight of water in adjacent zones. The temperature in the sterilization zone is directly related to the pressure of the saturated steam. The sterilization process can be controlled by varying the pressure, and thus the temperature, in the sterilization zone.

A typical hydrostatic system is used for treating workpieces such as sterilizing cans for foods or beverages. These systems usually consist of four or more stages, each with a height of several meters. The first stage serves as a preheating section, in which a hydrostatic column serves as an inlet section. The second stage includes a sterilization zone, where a workpiece is heated to the requisite sterilization temperature using steam. The third stage includes a hydrostatic cooling section that the product ascends through after leaving the sterilizing zone. At this stage, with the pressure gradually decreasing and the product gradually cooling, spray water jets may be used to provide additional cooling. At that the final stage, the cooling cycle is completed in the fourth tower at atmospheric pressure.

Examples of hydrostatic systems include retort systems such as illustrated in FIG. 1. Retort systems sterilize canned products after they are sealed. Hydrostatic sterilizers use a column of water to maintain the pressure in the sterilizing zone. The conveyor line of containers enters the sterilizer at the top of the water column and travel downward to the bottom of the steam dome, which is the heart of the sterilizer, as seen in FIG. 1. Once in the steam dome, the containers make several passes through the steam zone before being conveyed again to the bottom of the steam dome, into the exit water column and out of the sterilizer. The water column keeps steam inside the steam dome and provides the necessary pressurization. The height of the water column, approximately 35 feet, usually mandates that the equipment is located outdoors.

The containers are carried through the cooker on mild steel bars which are mounted at each end on a continuous chain. The chain loops up and down through a pre-heat leg where the cans are contacted with hot water at about 170 to 180° F. through a steam chamber and finally through a cooling leg before being spray cooled with cooler water at about 65-85° F. The total process time varies between 10 and 60 minutes, and the temperature in the cooker ranges from 90 to 212° F.

Hydrostatic systems in the food and beverage industry employ processes that generally include filling a container with food or beverage product, sealing it and then heating it to destroy any residual microorganisms. After the container is heated for the required period of time, it is cooled to ambient temperature either for storage or shipment. During this process, the corrosion of containers and the cooker must be carefully controlled through a properly designed chemical treatment program. Currently used chemical treatment methods for controlling the vapor phase and liquid phase corrosion or staining on containers in hydrostatic systems are not very effective.

Moreover, containers used in hydrostatic systems are typically made of aluminum or some alloy thereof. Conventionally, in order to resist corrosion of the container, the container is coated with a protective substance, such as tin, through an electrolytic process during manufacture of the container. Likewise, the container may be coated with a polymer coating such as an epoxy coating.

Additionally, there are various issues associated with the operation and maintenance of equipment used in a hydrostatic environment including scale and corrosion of in-feed and exit legs, can abrasion, corrosion, staining, vapor phase corrosion, microbiologically induced corrosion, and the like. Poor corrosion control in a hydrostatic cooker leads to excess corrosion rates of about 1.3 mm per year (mpy) and can be as high as 50 mpy. An aggressive processing environment and poor quality makeup water can exacerbate the issues.

SUMMARY

These and other issues are addressed by the disclosure. The inventors have discovered that stannous-based liquid phase corrosion inhibitors can form a tenacious protective layer on metal surfaces in a hydrostatic environment. Thus, it is an object of this disclosure to provide a method for controlling the liquid phase corrosion of metal surfaces of workpieces and equipment in a hydrostatic system.

In a first embodiment, there is provided a method of inhibiting corrosion of a corrodible metal surface that contacts water and/or steam in a hydrostatic system. The method may include treating the hydrostatic system with a treatment composition including a liquid-phase corrosion inhibitor that includes a stannous compound, wherein the treatment composition is provided in a sufficient amount and for a sufficient time to form a stable protective film on at least a portion of the corrodible metal surface.

In another embodiment, there is provided a method of treating a hydrostatic system to prevent corrosion of a metal article having a corrodible metal surface that contacts water in the system. The method may include adding to the hydrostatic system a stannous-based liquid-phase corrosion inhibitor, contacting the metal article with a water phase and water vapor phase in the hydrostatic system, and forming a stable corrosion-resistant film on at least a portion of the corrodible metal surface.

DETAILED DESCRIPTION

Overview

Figure 1:
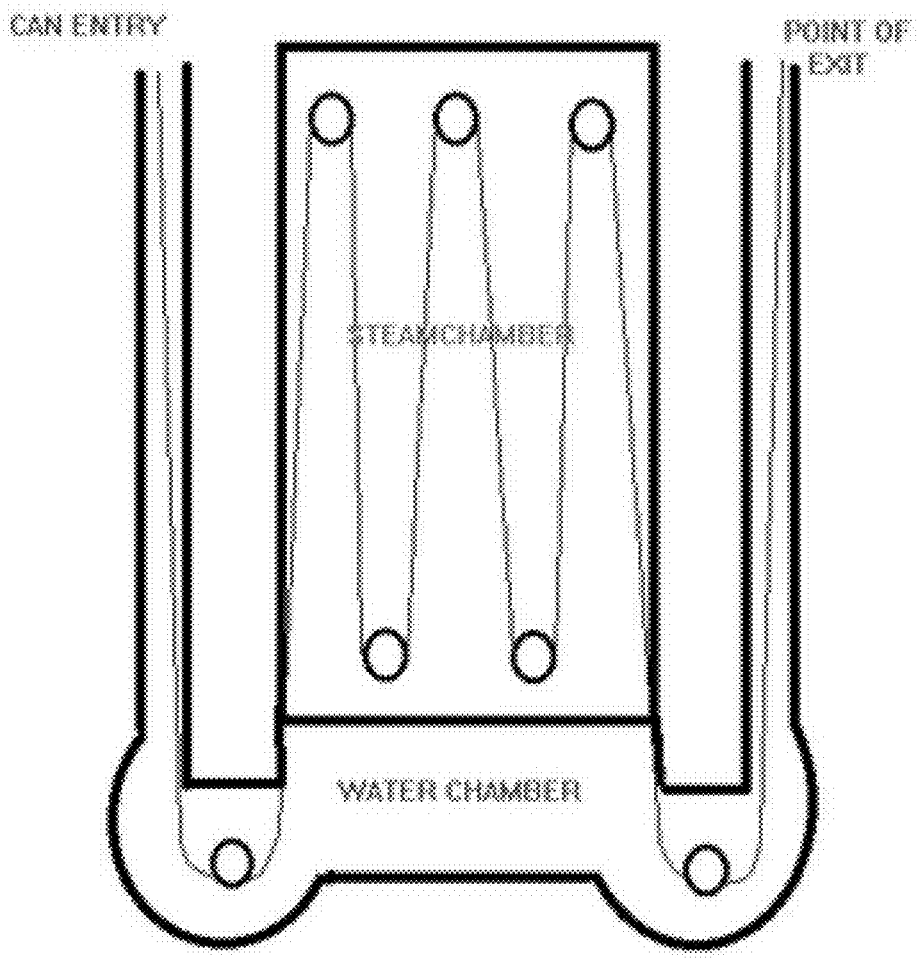
FIG. 1 is a schematic illustration of a conventional hydrostatic cooker.

The liquid-phase corrosion inhibitors according to embodiments are useful in any suitable hydrostatic environment. For example, the hydrostatic environment of the sterilization zone filled with steam may be at a predetermined cooking temperature in the range of 212° F. to 350° F., or preferably, 230° F. to 300° F., or more preferably, 250° F. to 270° F. The cooking pressure in the sterilization zone may be suitably held at a pressure in the range of 1 atm to 20 atm, or preferably, 1 atm to 10 atm, or more preferably 1 atm to 5 atm. The hydrostatic environment of the inlet zone filled with water may be at a predetermined temperature in the range of 175° F. to 245° F., or preferably, 200° F. to 225° F., or more preferably, 210° F. to 212° F. Similarly, the hydrostatic environment of the outlet zone filled with water may be at a predetermined temperature in the range of 175° F. to 245° F., or preferably, 200° F. to 225° F., or more preferably, 210° F. to 212° F.

Hydrostatic environments are unique industrial environments. These environments demand a unique pressurized sterilization chamber where pressurized steam is balanced in a sterilization chamber by adjacent liquid phase inlet, outlet and cooling water columns. This environment further demands a unique structural configuration with legs several meters high as described herein in order to accommodate the challenges associated with maintaining the sterilization environment of pressurized steam. By way of illustration, boiler systems are completely different than hydrostatic systems. In contrast to hydrostatic systems, boilers do not maintain pressurized steam counterbalanced by water chambers and are not concerned with using steam for sterilization. Boilers are closed systems used in heating applications by heating and/or maintaining a liquid at a high temperature without steam. Also, the presence of four different stages with different operating conditions makes the operation of hydrostatic cookers even more unique.

Liquid-phase corrosion inhibitors deposit from liquid, such as a water stream on the surface of a metal to be protected. Liquid-phase corrosion inhibitors form a protective film on the surface of the metal by precipitating out of solution and forming a layer. Treatment of corrosion in water systems using liquid-phase corrosion inhibitors is conventionally achieved by continuous application of various corrosion inhibitors in the water including, for example, phosphates, chromates, zinc, molybdates, nitrites, and combinations thereof. These inhibitors are active and work by the principle of shifting the electrochemical corrosion potential of the corroding metal in the positive direction indicating the retardation of the anodic process (anodic control), or displacement in the negative direction indicating mainly retardation of the cathodic process (cathodic control). In hydrostatic systems, these corrosion inhibitors can cause adverse effects such as scaling/fouling and microbial growth issues. Also, these corrosion inhibitors act more like protective inhibitors and not as passivation inhibitors. In contrast, the stannous corrosion inhibitor employed in embodiments disclosed herein surprisingly form a long-lasting and durable film on corrodible metal surfaces even when the metal surface is removed from the liquid phase of the hydrostatic system, e.g., such as workpieces that are sterilized in a hydrostatic cooker.

The liquid-phase corrosion inhibitors according to embodiments may also be used with vapor-phase corrosion inhibitors that deposit from a vapor phase on a metal surface to be protected. Vapor-phase corrosion inhibitors are protective as long as there is sufficient inhibitor in the vapor phase surrounding the metal to maintain a condensed phase on the surface. In this manner, the vapor phase acts as a transport medium from a source to the corrosion site. The vapor-phase corrosion inhibitor should be volatile enough so that all surfaces to be protected are readily reached but not so volatile that it is rapidly depleted through leaks in the containment vessel in which it is used. Formulations have been developed that protect ferrous and nonferrous metals.

The corrosion inhibitor treatment according to embodiments provides several advantages over conventional treatments and no treatment at all. Due to the nature of a hydrostatic system, workpieces and equipment in the system are subjected to transient and volatile conditions due to repetitive sterilization cycles and up-time/down-time. These conditions in of themselves create a more corrosive environment where the absence of any treatment at all is not a sustainable option.

Additionally, the transient nature of treating workpieces makes it very challenging to adequately protect workpieces with conventional corrosion treatments. For example, in order to treat workpieces in a hydrostatic system with a liquid-phase corrosion inhibitor, the inhibitor should be present in the liquid phase of the hydrostatic system. In typical hydrostatic systems, a workpiece may be exposed to the liquid phase on the order of for 1 hour to 5 days, or 2 hours to 3 days, or even 2 hours to 24 hours. The specific sterilization time will be influenced by the type of workpiece, the nature of the target of sterilization (e.g., microbes, etc.) and any pertinent regulatory standards. This creates a very limited window within which to treat the workpiece with a liquid-phase corrosion inhibitor. Liquid-phase corrosion inhibitors according to embodiments provide surprisingly effective liquid-phase treatment within this window that lasts even when the workpiece is removed from the hydrostatic environment.

The composition of the workpieces and equipment in the hydrostatic system also present challenges. For example, workpieces or containers used in the food and beverage industry are conventionally made of steel, aluminum, nickel, and the like, or some alloy thereof. Similarly, equipment in hydrostatic systems are conventionally made out of steel, aluminum, nickel, copper and the like, or some alloy thereof. The materials are highly corrosive, particularly in high heat, high humidity, and volatile environments like a hydrostatic environment.

Moreover, containers used in the food and beverage industry are often treated with an electrolyte, epoxy or polymeric coating to prevent corrosion on the inside or outside of the container. These coatings are highly susceptible to defects in the coating or imperfections caused by scraping, abrasion and scuffing. Such imperfections can be caused by the workpieces rubbing against each or against equipment prior to or during the hydrostatic sterilization, during storage, during transport or the like. These defects or scuffing in these coatings are considered to create vulnerable corrodible metal surfaces in the underlying metal container by exposure of the surface to corrosive elements in the hydrostatic system. Liquid-phase corrosion inhibitors according to embodiments provide surprisingly effective treatment for these types of workpieces and equipment in hydrostatic systems by not only creating a durable protective film on metal surfaces but by enhancing the durability of pre-existing protective electrolyte, epoxy or polymeric films, thereby increasing the overall utility and effectiveness of this treatment. The treatment likewise improves the appearance of workpieces that have these type of friction imperfections on the coating because the treatment according disclosed embodiments substantially reduces staining from corrosion occurring at the site of the defect.

In embodiments, treatment with liquid-phase corrosion inhibitors for as short as perhaps one hour or less may provide a durable protective film that lasts up to several days, weeks or even months. As containers used in the food and beverage industry face significant wear and tear during transport and distribution, as well as long-term storage conditions, the protective films generated using liquid-phase corrosion inhibitors according to embodiments are very important in industry today.

Further, in hydrostatic systems, water is often recycled and retained in the system. In the case of conventional zinc-based corrosion inhibitors, for example, there is significant residual that remains in the recycled water and ultimately precipitates out causing significant fouling problems. According to embodiments, there is very little residual inhibitor left over from the liquid-phase corrosion inhibitor in the recycled water. Therefore, liquid-phase corrosion inhibitors according to embodiments are also very environmentally friendly and are a cost-effective industrial resource.

The Liquid Anti-Corrosion Formulation

In one aspect, this disclosure provides an unexpectedly beneficial application of stannous-based corrosion inhibitors for protecting sterilization equipment and workpieces in hydrostatic systems.

In embodiments, a workpiece may be any product or container with a corrodible surface for which sterilization is desired such as, for example, an aluminum food or beverage can. Other containers include glass bottles with metal caps, and the like. Equipment used in the hydrostatic system may include, but is not limited to, a carrier for holding a container, a conveyer for conveying a carrier, a tube, a joint, a chain, a belt, a roller, a partition, a wall, and the like.

In a first embodiment, there is provided a composition for preventing corrosion of equipment and workpieces having corrodible metal surfaces that contact water in a hydrostatic system. The treatment composition may include a liquid-phase corrosion inhibitor, such as stannous-based corrosion inhibitor. The liquid-phase corrosion inhibitor may be any suitable corrosion inhibitor for application in aqueous environments. Stannous-based corrosion inhibitors, such as Tin (II)/stannous chloride or the like, form a very tenacious and persistent inhibitor film on the surface of corrodible metal. Stannous-based corrosion inhibitors may include, for example, ChemTreat FlexPro™ CL5632, manufactured by ChemTreat, Inc., ChemTreat FB1633, or the like.

The stannous-based corrosion inhibitor (e.g., stannous chloride) may be applied in any suitable amount. The stannous-based inhibitors may be present in the corrosion inhibitor composition in amounts by weight of 1 to 50%, or preferably, 1 to 20%, 1 to 12.5%, or more preferably, about 1 to 5%.

In the hydrostatic system, the concentration of the tin (i.e., as Tin(II)) from the stannous inhibitor in the water of the liquid phase can be from about 0.2 to 2000 ppm, or preferably, 0.5 to 100 ppm, or more preferably, about 1 to 10 ppm.

Unlike phosphate and zinc-based passivation treatments, these stannous salt formulations can be applied at effective levels without risk of fouling heat transfer surfaces. Moreover, the stannous salt passivation formulations pose much less risk to the environment than the chromate, zinc, and phosphate chemistries conventionally used in hydrostatic systems. Conventional phosphate and zinc-based treatments, for example, form temporary, permeable coatings highly susceptible to corrosion and staining. In contrast, stannous-based treatments provide more durable and protective coatings on both product containers and the equipment in the hydrostatic system. These films are highly beneficial in a commercial setting due to their strength and long lasting protection. Unlike conventional corrosion inhibitors, the containers treated according to disclosed embodiments produce containers with reduced staining and unexpected wear resistance that persists long after treatment in the hydrostatic system, which makes their use in commercial settings advantageous. Protective coatings formed using disclosed liquid-phase corrosion inhibitors can be sustained for several hours up to a few days in various storage environments including outdoor and high-humidity climates. This allows the containers to be stored in long-term storage environments without unwanted staining, corrosion or other degrading for long periods of time.

Without intending to be bound by theory, it is believed that stannous compounds undergo oxidation at the vulnerable metal surfaces, or those surfaces in need of corrosion protection, and form a durable insoluble protective film. These metal surfaces can also react with the stannous compounds to form metal-tin complexes, which again form protective films on the metal surface. Stannous inhibitors applied in accordance with the disclosed methods appear to form a protective film on reactive metals by at least three possible mechanisms. A first mechanism involves forming an insoluble stannous hydroxide layer under alkaline conditions. This stannous hydroxide appears to oxidize further to form a stannate oxide layer, which is even more insoluble, resulting in a protective film which is resistant to dissolution from the surface even in the absence of stannous salts in the process water. A second mechanism may be achieved under acidic conditions or in the presence of surface oxidants, for example, ferric or cupric ions, whereby the stannous salts can be directly oxidized to highly insoluble stannate salts. These stannate salts then precipitate onto the metal surface to form a protective layer and provide the desired corrosion inhibition function. A third mechanism may be achieved under alkaline conditions whereby existing metal oxides are reduced to more stable reduced forms that incorporate insoluble stannate salts in a hybrid film.

In preferred embodiments, the corrosion inhibitor is provided as a stannous salt selected from the group consisting of stannous sulfate, stannous bromide, stannous chloride, stannous oxide, stannous phosphate, stannous pyrophosphate, and stannous tetrafluoroborate. Other reactive metal salts such as, for example, zirconium, aluminum, and titanium salts, triazole or imidazoline or mixtures thereof may also be used in pre-treatment methods according to this disclosure. For example, embodiments of the disclosed methods may be operable with any metal salt capable of forming stable metal oxides resistant to dissolution under the conditions in the targeted system.

In the treatment of systems which are aqueous, such as hydrostatic cookers, additional corrosion inhibitors may be used such as, for example, water soluble zinc salts; phosphates; polyphosphates; phosphonic acids and their salts for example, acetodiphosphonic acid, nitrilotrismethylene phosphonic acid and methylamino dimethylene phos-phonic acid, other phosphonocarboxylic acids and their salts, 2-phosphonobutane-1,2,4-tricarboxylic, chromates such as sodium chromate; nitrates and mixtures thereof.

The treatment composition may also include a vapor-phase corrosion inhibitor. The vapor-phase corrosion inhibitor is particularly useful for protecting metal surfaces of equipment used in the hydrostatic system. The vapor-phase corrosion inhibitor may be any suitable volatile corrosion inhibitor, such as, for example, a volatile primary or secondary amine. Generally, volatile organic compounds are organic chemicals that have a relatively high vapor pressure at ordinary room temperature. Volatile amines according to this disclosure tend to exhibit a vapor pressure at 100° F. in the range of 10 to 25 psi. Under these conditions, the amines will typically vaporize into the gas phase even when mixed with the water.

According to embodiments, the volatile amine may include an organic amine-based compound including, but not limited to, the nitrite, carbonate, and benzoate salts of dicyclohexylamine, cyclohexylamine, polyamines, cetamines, hexamethyleneimine and other polar substances. In preferred embodiments, the amine may be octadecylamine (ODA). ODA has the formula ($CH_3(CH_2)\ 16CH_2NH_2$). The electronegativity of the N atom is the center of a large polar group (hydrophilic group) and non-polar group (hydrophobic group) of the hydrocarbon composition. The lone pair of electrons of the N atom bond with the metal surface and hold the non-polar group away from the metal surface to form a hydrophobic protective film against corrosion effect. Other suitable amines may include trimethylamine, monoethanolamine, ethylenediamine, morpholine, dimethylethanolamine (DMAE), N-methylmorpholine, cyclohexylamine, or similar, and mixtures thereof.

The corrosion treatment composition may include the liquid-phase and vapor-phase corrosion inhibitors in any suitable ratio in formulation, ranging from 1:10 to 10:1, or preferably, 1:5 to 5:1, or more preferably, 1:3 to 3:1, depending on the demands of the hydrostatic system and environment. Further, the treatment may include the liquid-phase and vapor-phase corrosion inhibitors in a single formulation or separate formulations. In the single formulation embodiment, a stable combination formulation may include the vapor-phase corrosion inhibitor in 1 to 40% by weight or preferably, 1 to 15% by weight, or more preferably, 1 to 5% by weight and the liquid-phase corrosion inhibitor in 1 to 50% by weight or preferably, 1 to 25% by weight, or more preferably, 1 to 12.5% by weight. In the hydrostatic system, whether according to the single formulation or separate formulations embodiment, the concentration of the volatile amine in the water may be from about 5 to 100 ppm, or preferably, about 5 to 50 ppm, or more preferably, about 10 to 15 ppm.

The corrosion treatment composition may also include adding the liquid-phase corrosion inhibitors in conjunction with one of more polymeric compounds for scaling inhibition and/or dispersants to suspend the inhibitors. The compounds may include, for example, unsaturated carboxylic acid polymers such as polyacrylic acid, homo or co-polymaleic acid (synthesized from solvent and aqueous routes); acrylate/2-acrylamido-2-methylpropane sulfonic acid (AMPS) copolymers, acrylate/acrylamide copolymers, acrylate homopolymers, terpolymers of carboxylate/sulfonate/maleate, terpolymers of acrylic acid/AMPS; phosphonates and phosphinates such as 2-phosphonobutane-1,2,4-tricarboxylic acid (PBTC), 1-hydroxy ethylidene-1,1-diphosphonic acid (HEDP), amino tris methylene phosphonic acid (ATMP), 2-hydroxyphosphonocarboxylic acid (HPA), diethylenetriamine penta(methylene phosphonic acid) (DETPMP), phosphinosuccinic oligomer (PSO); salts of molybdenum and tungsten including, for example, nitrates and nitrites; amines such as N,N-diethylhydroxylamine (DEHA), diethyl amino ethanol (DEAE), dimethylethanolamine (DMAE), cyclohexylamine, morpholine, monoethanolamine (MEA); azoles such as tolyltriazole (TTA), benzotriazole (BZT), butylbenzotriazole (BBT), halogenated azoles and their salts, and mixtures thereof. The concentration of the scaling inhibitor and/or dispersant in the water system during the treatment may be from about 1 to 50 ppm, or preferably, 2 to 20 ppm, or more preferably, about 6 ppm.

The corrosion treatment composition may also include additional corrosion or scaling inhibition and/or vapor or liquid phase treatment chemistry known in the art can be introduced into the system in conjunction with the treatment compositions to further improve corrosion or scaling inhibition performance and control deposition of undesirable species. As will be appreciated, the treatment methods according to the disclosure can be paired with other treatment or conditioning chemistries that would be compromised by the continuous presence of the corrosion inhibitor. Alternatively, "greener" treatment packages or treatment packages designed to address other parameters of the system operation can be utilized along with the treatment feedings to improve the quality of the system effluent and/or reduce the need for effluent treatment prior to discharge.

Examples

Figure 2D:
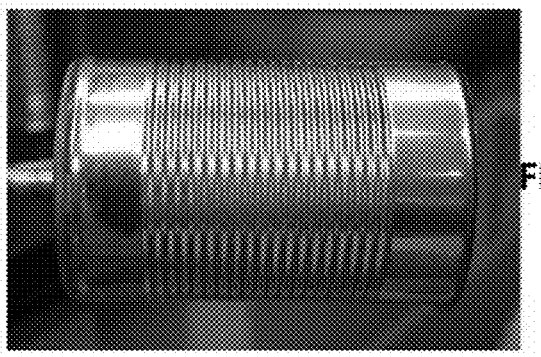
FIGS. 2A, 2B, 2C and 2D are photographs illustrating corrosion inhibition experiments according to comparative techniques and according to embodiments.
Figure 2C:
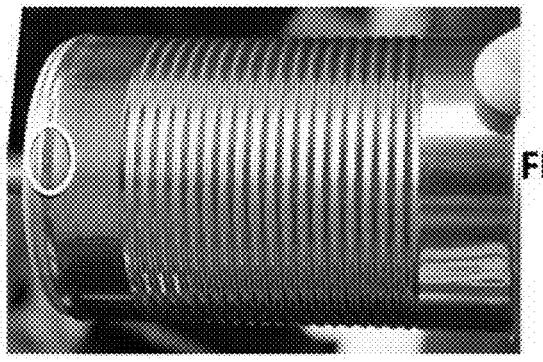
Figure 2B:
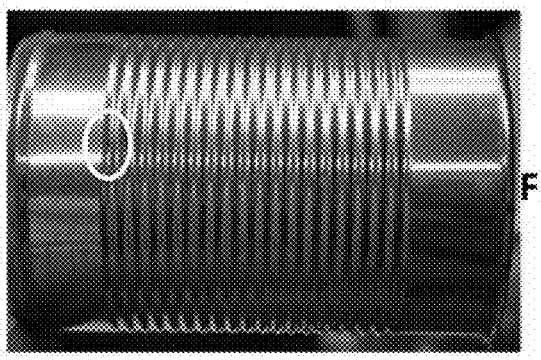
Figure 2A:
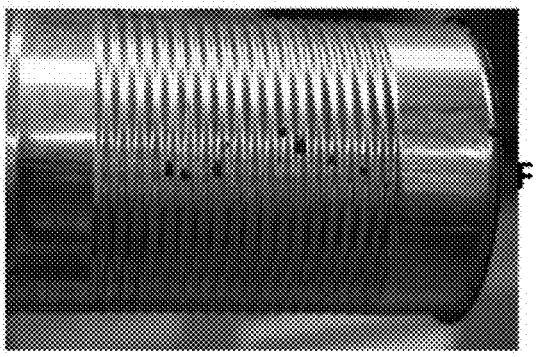

FIGS. 2A-D show the effectiveness of the liquid-phase corrosion inhibitor in forming a protective film on the steel surfaces of the sides of containers. FIGS. 2A-D illustrate the results of passing a treated metal container through a hydrostatic environment for several seconds at 165° F. Conditions of the hydrostatic environment were as follows: pH: 8.0 to 8.5, total hardness: 50-100 ppm as $CaCO_3$, total alkalinity: 150-250 ppm as $CaCO_3$, chlorides: 250-250 ppm as Cl—, and total dissolved solids: 1000-1500 ppm. As shown in FIGS. 2A-D, liquid-phase corrosion inhibitors according to this embodiment exhibit significant anti-corrosive effect over conventional treatments. FIG. 2A corresponds to Sample A (control blank). FIG. 2B corresponds to Sample B (traditional phosphate-based approach). FIG. 2C corresponds to Sample C (100 ppm of corrosion inhibitor composition including stannous chloride, polymaleic acid, citric acid and ODA). FIG. 2D corresponds to Sample D (200 ppm of corrosion inhibitor composition including stannous chloride, polymaleic acid, citric acid and ODA). Samples A, B and C all exhibit significant corrosion, as indicated in FIGS. 2A-C. Sample D clearly shows that the stannous-based solution forms a stable protective film that resists corrosion, while the lower concentration of the stannous-based inhibitor, the phosphate-based inhibitor and the blank are not as effective.

Figure 3D:
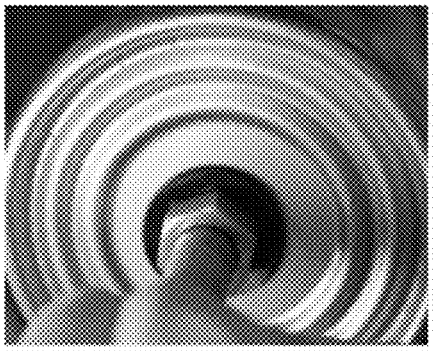
FIGS. 3A, 3B, 3C and 3D are photographs illustrating experiments according to comparative techniques and according to embodiments.
Figure 3C:
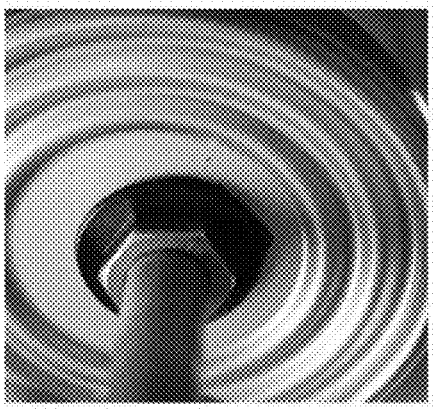
Figure 3B:
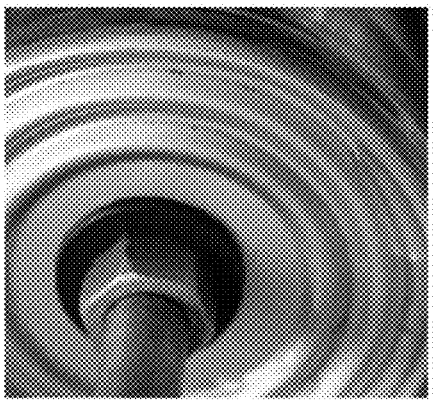
Figure 3A:
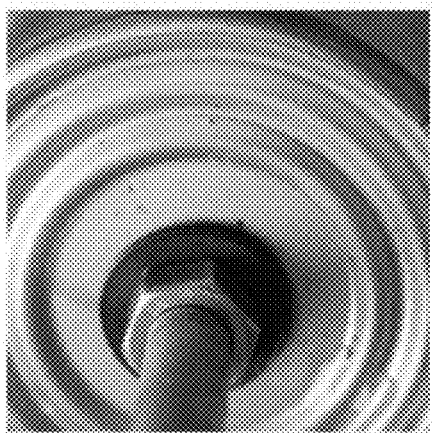

FIGS. 3A-3D show the effectiveness of the liquid-phase corrosion inhibitor in forming a protective film on the steel surfaces of the tops of containers. FIGS. 3A-3D illustrate the results of passing a treated metal specimen through a hydrostatic environment for several seconds at 165° F. Conditions of the hydrostatic environment were as follows: pH: 8.0 to 8.5, total hardness: 50-100 ppm as $CaCO_3$, total alkalinity: 150-250 ppm as $CaCO_3$, chlorides: 250-250 ppm as Cl—, and total dissolved solids: 1000-1500 ppm. As shown in FIGS. 3A-3D, liquid-phase corrosion inhibitors according to this embodiment exhibit significant anti-corrosive effect over conventional treatments. FIG. 3A corresponds to Sample E (control blank). FIG. 3B corresponds to Sample F (traditional approach using a phosphate-based liquid corrosion inhibitor). FIG. 3C corresponds to Sample G (100 ppm of corrosion inhibitor composition including stannous chloride, polymaleic acid, citric acid and ODA). FIG. 3D corresponds to Sample H (200 ppm of corrosion inhibitor composition including stannous chloride, polymaleic acid, citric acid and ODA). Samples E and F both exhibit significant corrosion, as shown in the FIGS. 3A and 3B. Examples G and H clearly show that the stannous-based solution forms a stable protective film that resists corrosion, while the phosphate-based inhibitor and the blank are not as effective.

Figure 4A:
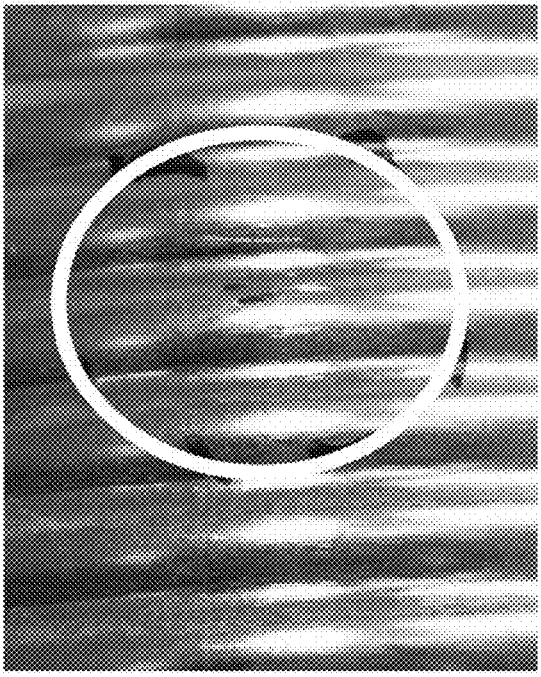
FIGS. 4A and 4B are photographs illustrating aluminum containers with an electrolytic coating that have been subjected to abrasion and subsequent sterilization in a hydrostatic environment with (FIG. 4B) and without (FIG. 4A) treatment with a liquid-phase corrosion inhibitor during sterilization in the hydrostatic environment according to embodiments.
Figure 4B:
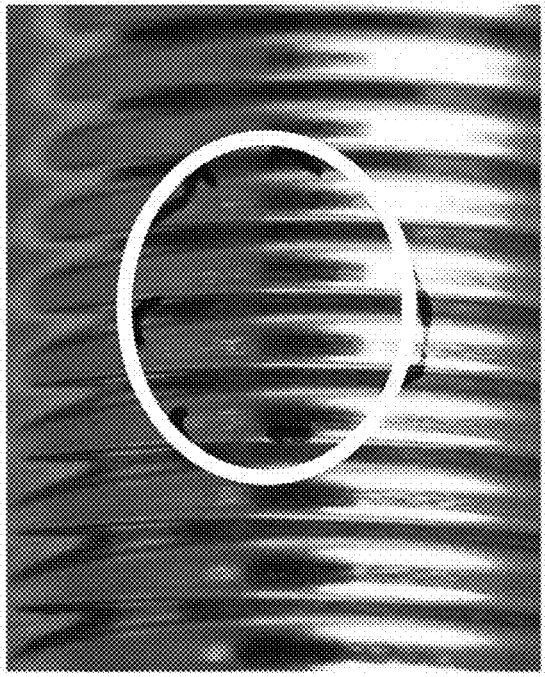

FIGS. 4A and 4B show the effectiveness of the liquid-phase corrosion inhibitor in forming a protective film on the steel surfaces of the sides of containers that have been pre-treated with an electrolytic coating. The containers were subjected to intentional abrasion by scuffing of the container. The containers were subsequently passed through a hydrostatic environment similar to the environment described above with respect to FIGS. 3A-3D and left to set for several days. The container illustrated in FIG. 4B was treated with ChemTreat FB1633 during the liquid-phase of the sterilization procedure in the hydrostatic environment. FB1633 is 200 ppm corrosion inhibitor composition by weight in composition, and was added to provide 3 ppm tin in solution. The container illustrated in FIG. 4A was not treated with FB1633. As shown in FIG. 4A, there was significant corrosion observed on the container that was not treated with the liquid-phase corrosion inhibitor. In contrast, as shown in FIG. 4B, the container that was treated with FB1633 during the liquid-phase in the hydrostatic environment exhibits little to no corrosion despite having been exposed to abrasion before entry into the hydrostatic environment. These results clearly show that the stannous-based passivation treatment forms a stable and long-lasting Tin(IV) protective film that resists corrosion that is superior to the absence of any liquid-phase corrosion treatment in a hydrostatic environment.

Figure 5A:
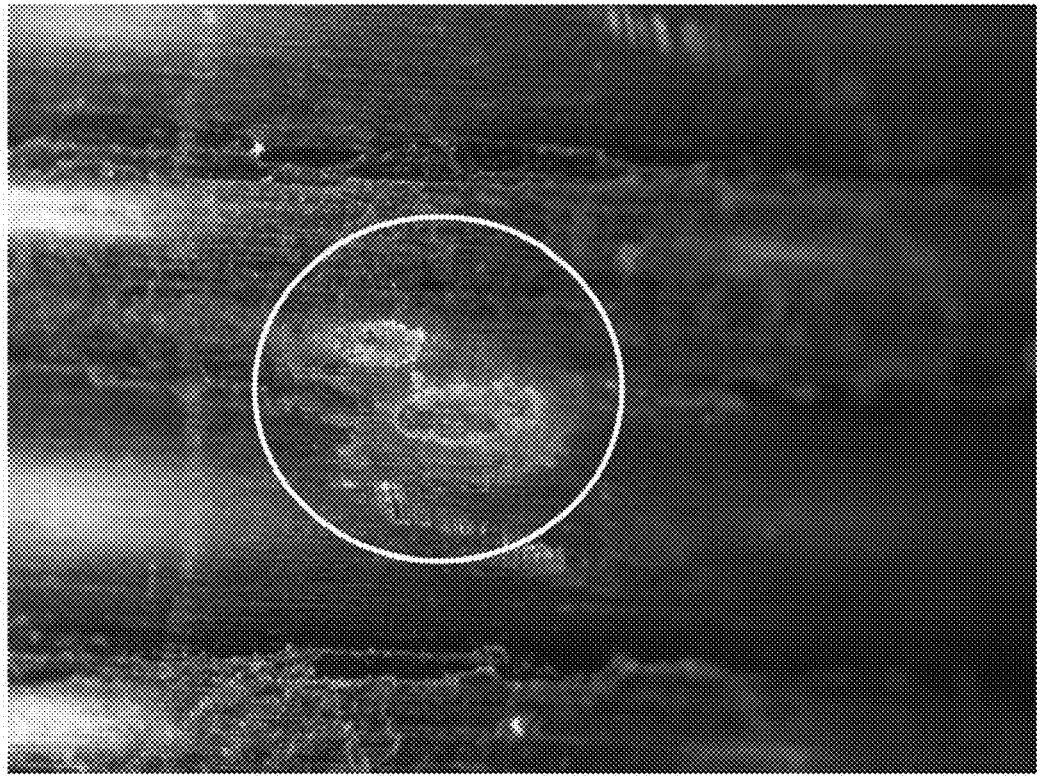
FIGS. 5A and 5B are close-up views of the photographs illustrated in FIGS. 4A and 4B, respectively.
Figure 5B:
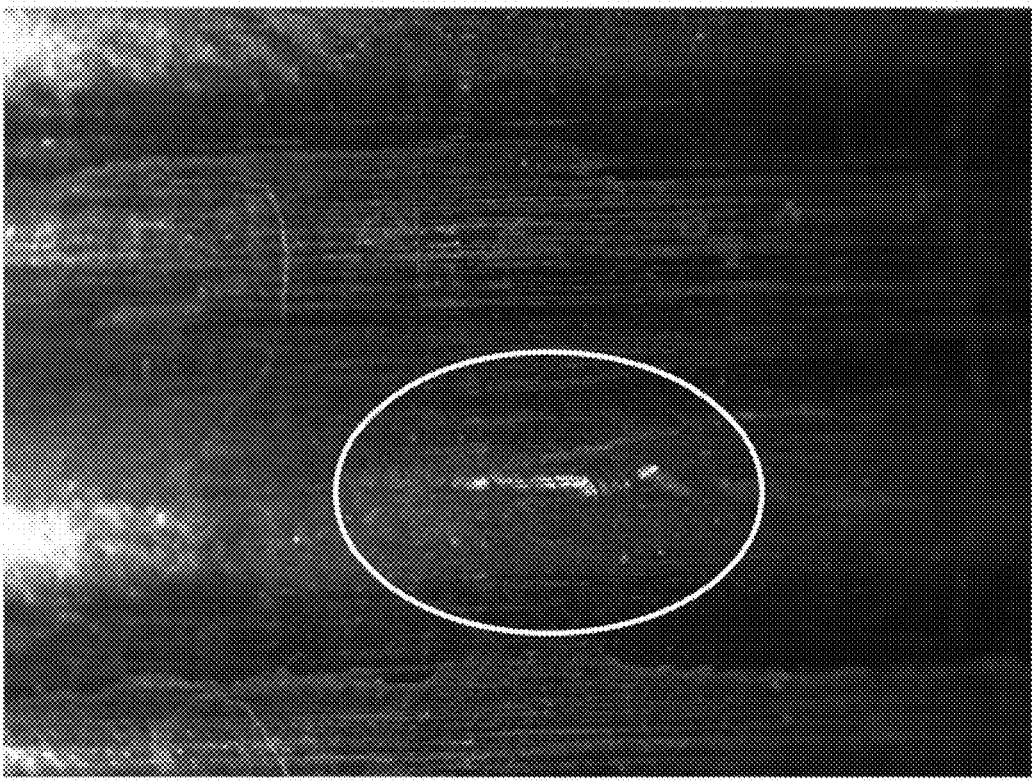
Figure 6A:
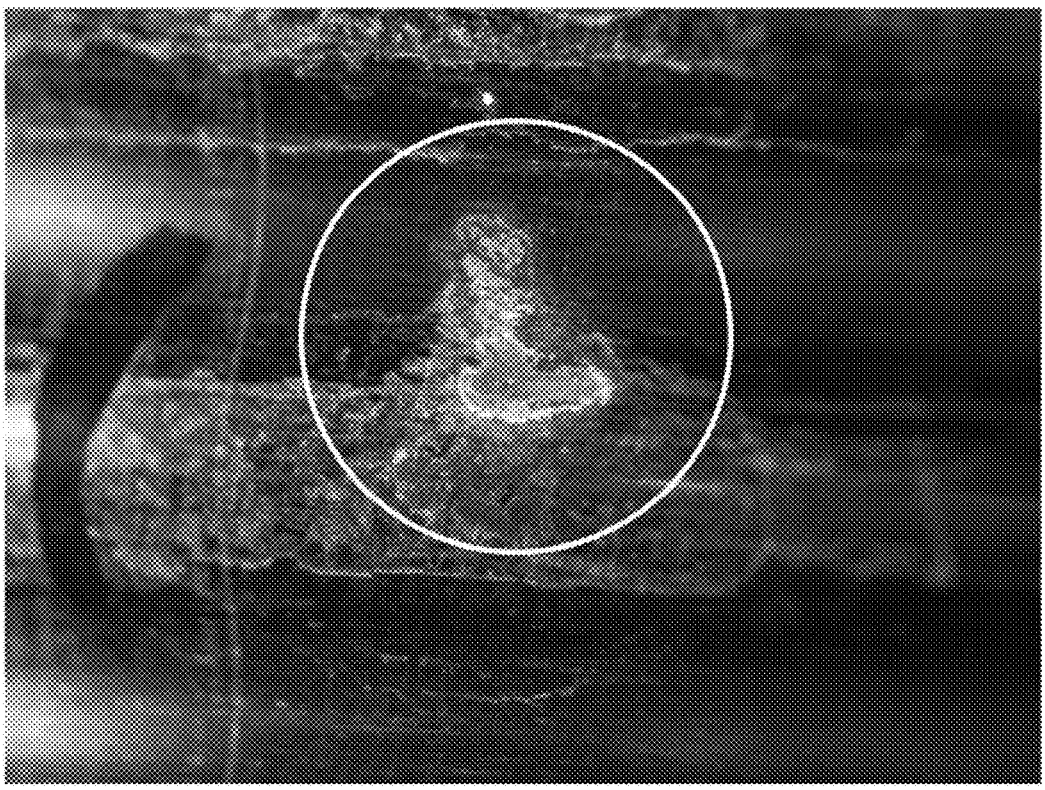
FIGS. 6A and 6B are close-up views of the photographs taken from another set of aluminum containers treated similarly to the cans illustrated in FIGS. 4A and 4B, respectively.
Figure 6B:
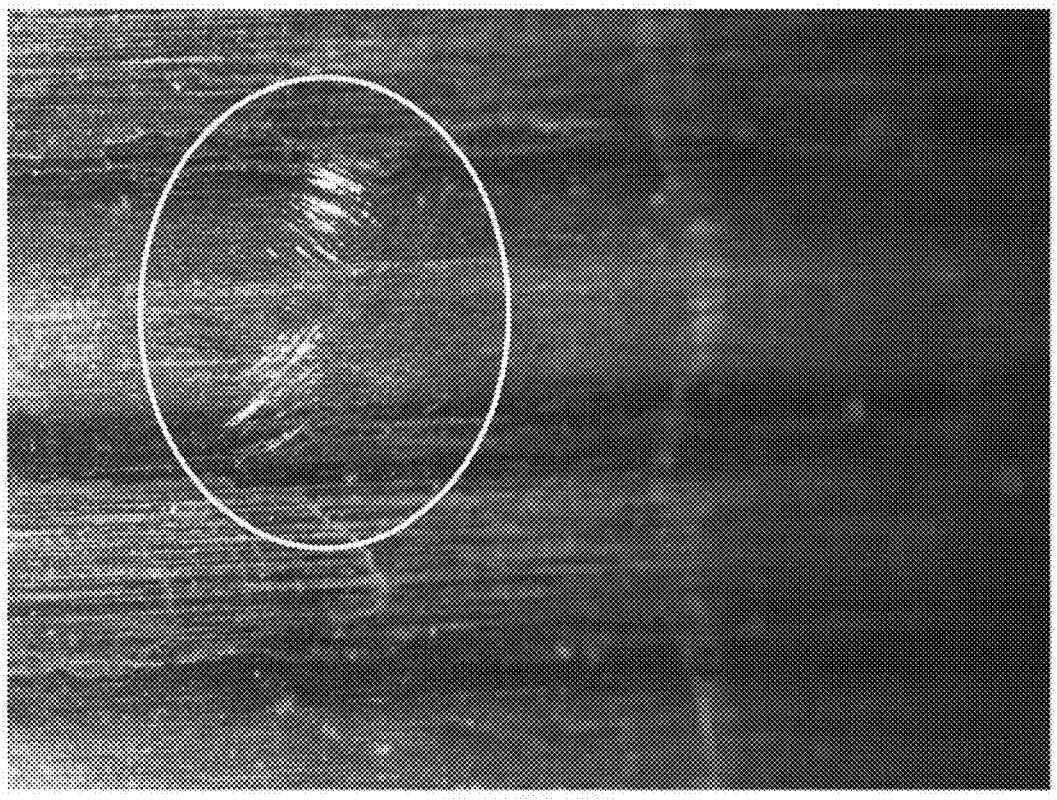

These findings were confirmed by microscopic analysis of the abrasions on the container shown in FIGS. 4A and 4B as seen in FIGS. 5A and 5B. FIGS. 5A and 5B are microscopic views of the photographs illustrated in FIGS. 4A and 4B, respectively. Similarly, FIGS. 6A and 6B are microscopic views of the photographs taken from another set of aluminum containers treated similarly to the containers illustrated in FIGS. 4A and 4B, respectively. The microscopic analysis confirms the surprisingly effective protective quality of the Tin(IV) protective film in terms of corrosion resistance.

Figure 7A:
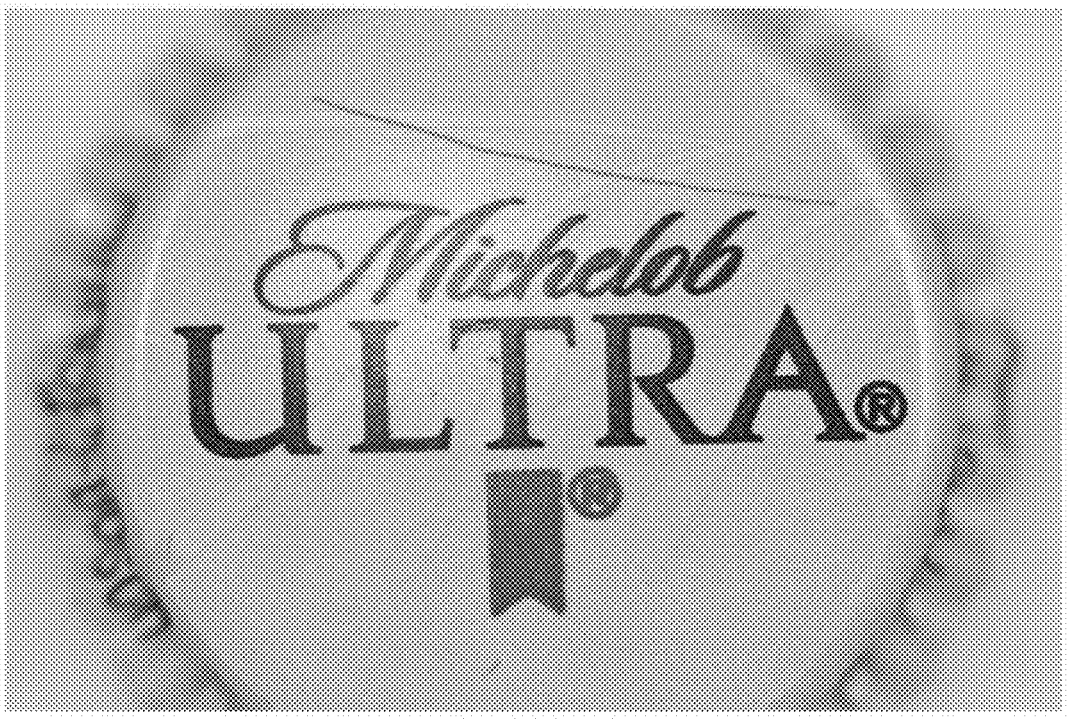
FIGS. 7A and 7B illustrate corrosion results of bottle caps that have been subjected to abrasion and subsequent sterilization in a hydrostatic environment with a liquid-phase corrosion inhibitor according to embodiments (FIG. 7A) and with a conventional liquid-phase corrosion inhibitor (FIG. 7B)
Figure 7B:
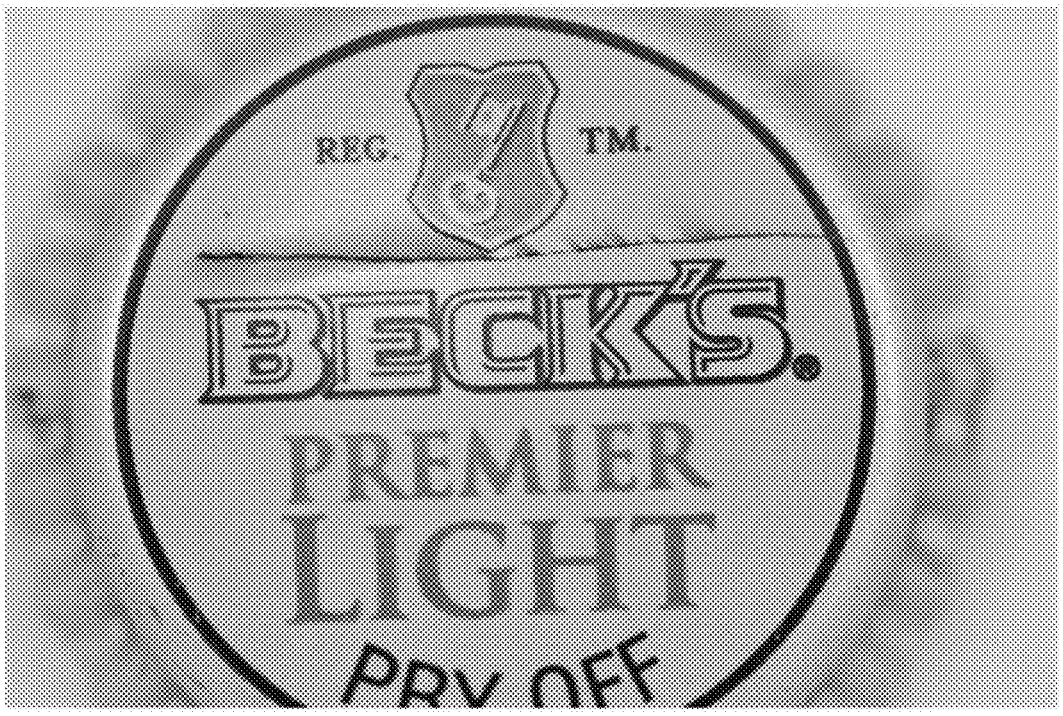

FIGS. 7A and 7B show the superior anti-corrosive effects of liquid-phase corrosion inhibitors according to embodiments in forming a protective film on the steel surfaces of aluminum bottle caps that have been subjected to abrasion. The bottle caps were subjected to abrasion by scratching the surface. The bottle caps were subsequently passed through a hydrostatic environment similar to the environment described above with respect to FIGS. 4A and 4B and left to set for several days. The bottle cap illustrated in FIG. 7A was treated with ChemTreat FB1633 during the liquid-phase of the sterilization procedure in the hydrostatic environment. The bottle cap illustrated in FIG. 7B was treated with a conventional phosphate treatment during the liquid-phase of the sterilization procedure in the hydrostatic environment. As shown in FIG. 7B, there was significant corrosion and staining observed on the bottle cap treated with the phosphate-based liquid-phase corrosion inhibitor. In contrast, as shown in FIG. 7A, the bottle cap that was treated with FB1633 during the liquid-phase in the hydrostatic environment exhibits little to no corrosion and no staining. These results clearly show that the stannous-based passivation treatment forms a stable Tin(IV) protective film that resists corrosion that is substantially superior to conventional phosphate treatments in a hydrostatic environment.

Application of the Treatment Composition

In embodiments, the treating methods can be controlled (e.g., sufficient amount of corrosion inhibitor and contact time) to form a protective film on at least a portion of the corrodible metal surface. Depending on the particular system, the feeding of the corrosion inhibitor composition can be implemented in several ways. As such, controlling the feeding can be important in arriving at the optimal treatment plan for a particular system.

Figure 8:
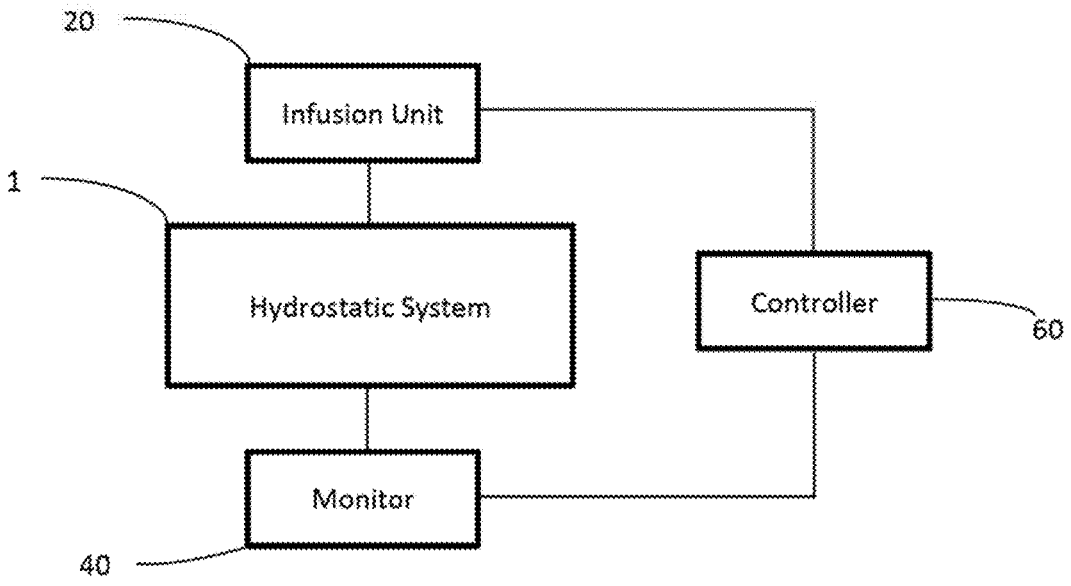
FIG. 8 is a schematic diagram of a control system for controlling the infusion of treatment composition in a hydrostatic system according to an embodiment.

Control of the amounts of corrosion inhibitor composition in the system is not particularly limited. Infusion control, including frequency, duration, concentrations, dosing amounts, dosing types and the like, may be controlled manually or automatically through, for example, an algorithm or a non-transitory computer medium executable by, for example, a CPU. FIG. 8 illustrates an exemplary system for controlling infusion of the treatment composition according to this embodiment. As shown in FIG. 8, controller 60 controls the infusion unit 20 for infusing the appropriate frequency, duration, concentrations, dosing amounts, dosing types and the like, of the treatment composition to hydrostatic system 1.

In these embodiments, the application of the treatment composition may be continuous or intermittent application and will depend on parameters of the system. With regard to intermittent application, the treatment composition may be applied for a first time period at a first concentration and during a first time period, and for a second time period at a second concentration and during a second time period. The second concentration and second time period may be lower than the first concentration and the first time period. The degree of corrosion or scaling in the system may be determined by monitoring the hydrostatic system through any suitable means known in the art. For example, as shown in FIG. 8, monitor 40 monitors a parameter of the hydrostatic system 1.

The treatment composition may be applied in the liquid-phase of the hydrostatic system while the liquid is at any suitable temperature for the system as discussed herein. In embodiments, the temperature may be from about 100° F. to 200° F., or more preferably, 135° F. to 180° F.

Referring to FIG. 8, disclosed methods may further comprise measuring a parameter of the metal surface of hydrostatic system 1 via monitor 40. Disclosed methods may further comprise introducing at least one subsequent dose of the treatment composition via infusion unit 20 and controlling the sterilization based on the parameter via controller 60. As will be appreciated, the frequency of the treatment dosing and the inhibitor concentration is a function of the system 1 being treated and can be set and/or adjusted empirically based on test or historical data. The success of the treatment dosing may be evaluated by monitoring the system 1. According to embodiments, the treatment method may further comprise measuring and monitoring a characteristic of the metal surface or system particularly after at least initial treatment or any subsequent dose to determine the timing, duration, concentration and/or frequency of subsequent treatment doses.

In embodiments, the duration of introducing the treatment dose is controlled by controller 60 based on the measured parameter, and the concentration of the corrosion or scaling inhibitor in the system 1 during any second or subsequent dose is controlled based on the measured parameter. The measured parameter may be indicative of a corrosive or scaling amount on the metal surface. The measured parameter may be indicative of a dissolution rate of the fouling deposit on the metal surface. For example, the measured parameter may be a hardness value of the deposit, heat transfer of a surface, visual cleanliness, pressure drop reduction, or flow improvement.

Methods and formulations according to embodiments provide an unexpectedly more efficient and effective anti-corrosion solution in the food and beverage industry. These methods and formulations might eliminate the need to pre-coat metal containers with a protective electrolyte film and provide a mechanism by which the treatment composition can be infused into the hydrostatic system in a single treatment stage to form a stable protective film on the container during the hydrostatic process. Disclosed embodiments further eliminate the need for different treatment chemistries and provide a reliable approach for using a single liquid and vapor-phase corrosion inhibitor for the entirety of the hydrostatic process.

Disclosed embodiments may be used in a variety of hydrostatic systems including, but not limited to, any plant employing hydrostatic systems such as, for example, food and beverage processing plants, steel manufacturing plants, smelting plants, and the like.

It will be appreciated that the above-disclosed features and functions, or alternatives thereof, may be desirably combined into different systems or methods. Also, various alternatives, modifications, variations or improvements may be subsequently made by those skilled in the art, and are also intended to be encompassed by the following claims. As such, various changes may be made without departing from the spirit and scope of this disclosure as defined in the claims.

What is claimed is:

1. A method of inhibiting corrosion of a corrodible metal surface that contacts water and/or steam in a hydrostatic system, the method comprising:

treating the hydrostatic system with a treatment composition including a liquid-phase corrosion inhibitor that includes a stannous compound, wherein the treatment composition is provided in a sufficient amount and for a sufficient time to form a stable protective film on at least a portion of the corrodible metal surface, and the corrodible metal surface is at least a portion of a surface of a metal container that is treated in the hydrostatic system.

2. The method of inhibiting corrosion according to claim 1, wherein the stannous compound includes a stannous chloride salt.

3. The method of inhibiting corrosion according to claim 1, wherein the treatment composition further comprises a scaling inhibitor.

4. The method of inhibiting corrosion according to claim 3, wherein the scaling inhibitor includes a polycarboxylic acid.

5. The method of inhibiting corrosion according to claim 1, wherein the treatment composition further comprises a polymer dispersant.

6. The method of inhibiting corrosion according to claim 5, wherein the polymer dispersant includes a 2-acrylamido-2-methylpropane sulfonic acid copolymer.

7. The method of inhibiting corrosion according to claim 1, wherein the stannous compound is present in the treatment composition in an amount in the range of 1 to 12.5% by weight.

8. The method of inhibiting corrosion according to claim 1, wherein the concentration of tin in the water of the hydrostatic system is in the range of 0.5 to 100 ppm.

9. The method of inhibiting corrosion according to claim 8, wherein the concentration of tin in the water of the hydrostatic system is in the range of 1 to 5 ppm.

10. The method of inhibiting corrosion according to claim 1, wherein the treatment composition is drip-fed into the hydrostatic system.

11. The method of inhibiting corrosion according to claim 1, wherein the treatment composition is continuously fed into the hydrostatic system.

12. The method of inhibiting corrosion according to claim 1, wherein the corrodible metal surface is-includes at least a portion of a surface of equipment used in the hydrostatic system.

13. The method of inhibiting corrosion according to claim 12, wherein the equipment is at least one of a carrier for holding a container, a conveyer for conveying a carrier, a tube, a joint, a chain, a belt, a roller, a partition, and a wall used in the hydrostatic system.

14. The method of inhibiting corrosion according to claim 1, wherein the container is an aluminum product used in the packaging and storing of food or beverage.

15. The method of inhibiting corrosion according to claim 1, wherein the treatment composition further comprises a vapor-phase corrosion inhibitor.

16. The method of inhibiting corrosion according to claim 15, wherein the vapor-phase corrosion inhibitor includes a volatile organic amine compound.

17. The method of inhibiting corrosion according to claim 15, wherein the vapor-phase corrosion inhibitor is present in the treatment composition in an amount in the range of 1 to 5% by weight.

18. The method of inhibiting corrosion according to claim 15, wherein the concentration of the vapor-phase corrosion inhibitor in the water of the hydrostatic system is in the range of 5 to 100 ppm.

19. The method of inhibiting corrosion according to claim 15, wherein a ratio of an amount of the stannous compound and the vapor-phase corrosion inhibitor in the treatment composition is in the range of 1:10 to 10:1.

20. A method of inhibiting corrosion of a corrodible metal surface that contacts water and/or steam in a hydrostatic system, the method comprising:

treating the hydrostatic system with a treatment composition including a liquid-phase corrosion inhibitor that includes a stannous compound, wherein the treatment composition is provided in a sufficient amount and for a sufficient time to form a stable protective film on at least a portion of the corrodible metal surface, the treatment composition further comprises a polymer dispersant, and the polymer dispersant includes a 2-acrylamido-2-methylpropane sulfonic acid copolymer.

21. A method of treating a hydrostatic system to prevent corrosion of a workpiece that passes through the hydrostatic system, the workpiece having a corrodible metal surface that contacts water in the hydrostatic system, the method comprising:

adding to the hydrostatic system a stannous-based liquid-phase corrosion inhibitor;

contacting the workpiece with a water phase in the hydrostatic system; and forming a stable corrosion-resistant film on at least a portion of the corrodible metal surface.

22. The method of treating a hydrostatic system according to claim 21, wherein the workpiece is substantially free of an electrolyte coating on the corrodible metal surface.

23. The method of treating a hydrostatic system according to claim 21, wherein the corrodible metal surface of the workpiece includes aluminum.

24. The method of treating a hydrostatic system according to claim 21, wherein the workpiece includes a polymeric coating on the corrodible metal surface.

25. The method of treating a hydrostatic system according to claim 21, wherein the stannous-based liquid-phase corrosion inhibitor is added to the hydrostatic system in a single dose.

26. The method of treating a hydrostatic system according to claim 21, wherein the workpiece remains in the hydrostatic system for a time period in the range of 2 hours to 3 days.

* * * * *